US005581902A

United States Patent [19]

Didion et al.

[11] Patent Number: 5,581,902

[45] Date of Patent: Dec. 10, 1996

[54] ROTARY DRYER DRUM

[75] Inventors: Charles J. Didion; Michael S. Didion, both of St. Charles County, Mo.

[73] Assignee: Didion Manufacturing Company, St. Peters, Mo.

[21] Appl. No.: 638,728

[22] Filed: Apr. 29, 1996

[51] Int. Cl.[6] ..... F26B 11/02

[52] U.S. Cl. ..... 34/136; 34/135; 366/215

[58] Field of Search ..... 34/135, 136, 137; 432/104, 105; 366/215

[56] References Cited

U.S. PATENT DOCUMENTS

| | | | |
|---|---|---|---|
| 876,440 | 1/1908 | Cummer | 34/135 |
| 1,196,376 | 8/1916 | Meyer | 34/135 |
| 1,961,314 | 6/1934 | Wall | 34/135 |
| 3,245,154 | 4/1966 | Bojner et al. | 34/135 |
| 5,522,158 | 6/1996 | Swanson | 34/479 |

*Primary Examiner*—Henry A. Bennett
*Assistant Examiner*—Dinnatia Doster
*Attorney, Agent, or Firm*—Paul M. Denk

[57] ABSTRACT

A rotary drum dryer is provided which will dissipate heat from the drum and which will allow the drum to expand. The rotary drum dryer includes an elongate cylindrical drum which rotates on a base and a tire assembly mounted to the drum. The tire assembly includes a band extending circumferencially around the drum and being radially spaced from the drum and a circumferential tire mounted on the band. A plurality of linkage assemblies are spaced around the drum to physically connect the tire assembly to the drum and a plurality of gussets which maintain a desired spacing between the tire assembly and the drum to allow the drum to move relative to the tire assembly. The gussets each include a gusset body having a top edge and a notch formed in the top edge. The gussets act as vanes to dissipate heat from the drum before the heat reaches the tire assembly.

12 Claims, 3 Drawing Sheets

ROTARY DRYER DRUM

BACKGROUND OF THE APPLICATION

This invention relates to rotary dryer drums, and in particular to a rotary dryer drum in which the drum may radially expand and in which heat transfer to the wheels and bearings of the drum is reduced.

Rotary drum dryers are used to dry a variety of products and to thermally treat foundry sand. When heating the products or sand, the heat from the product or sand is transferred to the drum, causing the drum to heat up and expand. Typically, the rotary drum is mounted on a base and includes wheels and bearings which allow to the drum to rotate on the base. When the drum does heat up, such heat is transmitted to the wheels and bearings. Such heat can be detrimental to the wheels and bearings.

The drum operates by tumbling the products through the dryer. As the products are tumbled, they create localized shocks or forces which are passed to the wheels and bearings. These localized forces can also damage the wheels and bearings.

SUMMARY OF THE INVENTION

One object of the present invention is to provide a new and improved rotary drum dryer.

Another object is to provide such a dryer which will reduce the transmission of heat from its drum to the drum's wheels and bearings.

Another object of the invention is to provide such a drum which allows for expansion of the drum without passing the forces of expansion to the wheels and bearings.

Yet another object of the present invention is to provide such a dryer in which the forces of the tumbling castings are transmitted over a larger area of the drum.

These and other objects will become apparent to those skilled in the art in light of the following disclosure and accompanying drawings.

In accordance with the invention, generally stated, a rotary drum dryer is provided which will dissipate heat from the drum and which will allow the drum to expand. The rotary drum dryer includes an elongate cylindrical drum which rotates on a base and a tire assembly mounted to the drum. The tire assembly includes a band extending circumferencially around the drum and being radially spaced from the drum and a circumferential tire mounted on the band. A plurality of linkage assemblies are spaced around the drum to physically connect the tire assembly to the drum and a plurality of gussets which maintain a desired spacing between the tire assembly and the drum. The linkage assemblies each include a drum bracket mounted to an outer surface of the drum, a band bracket mounted to an inner surface of the band, and an arm pivotally connected at one end to the drum bracket and pivotally connected at another end to the band bracket. The gussets each include a gusset body having a top edge and a notch formed in the top edge. The tire assembly rides in the notch and the notch has a depth greater than the radial width of the band. The gussets are preferably evenly spaced around the drum and the linkage assemblies are generally centered between adjacent gussets. The gussets act as fins to dissipate heat from the drum before the heat reaches the tire assembly. To increase the effectiveness of the gussets as heat dissipaters, the surface area of the gussets are increased by providing wings extending from opposite sides of the gusset body at a bottom of the gusset body, such that the gusset is wider at a bottom thereof than at a top thereof. The linkage assemblies serve to allow the drum to move relative to the tire assembly. However, the amount of movement is limited by the depth of the notch.

DESCRIPTION OF THE PREFERRED EMBODIMENT

Figure 1:
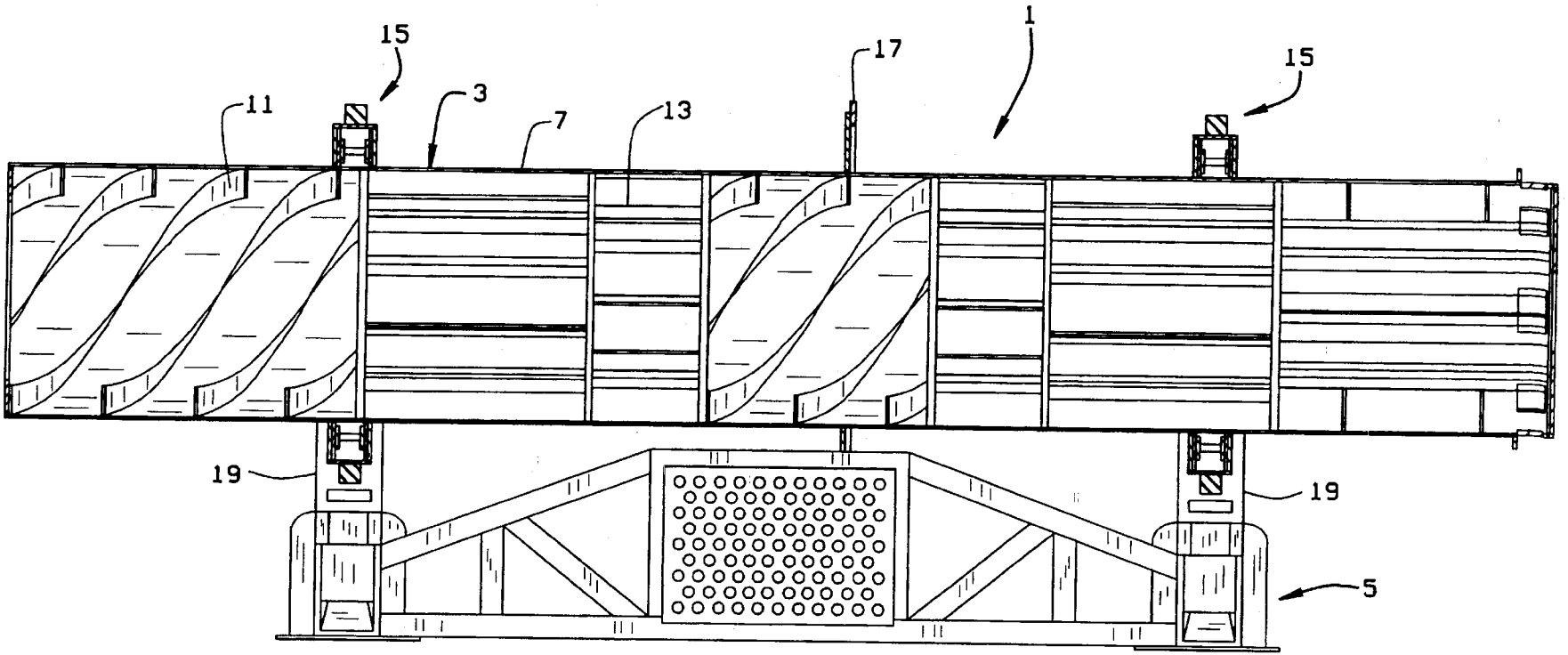
FIG. 1 is a cross-sectional view of a rotary drum dryer of the present invention.

A rotary drum dryer 1 of the present invention is shown generally in FIG. 1. The dryer 1 includes a drum 3 mounted on a base 5 for rotation. The drum 3 includes an outer shell 7 having an outer surface 8 and in inner surface 9. Various rifling elements 11 and lifters 13 are placed in the drum on the inner surface 9 to carry and tumble castings through the drum to dry and cool the castings. The drum also includes a pair of tire assemblies 15 placed near the front and back of the drum and a sprocket 17 positioned generally at the center of the drum.

The base 5 includes a motor (not shown) to which the sprocket 17 is operationally connected and a pair of spaced apart bearing or track assemblies 19 in which the tire assemblies 15 ride. As can be appreciated, the tire assemblies primarily provide for balance of the drum and the operation of the motor causes the sprocket 17, and hence the drum 3 to rotate.

Figure 2:
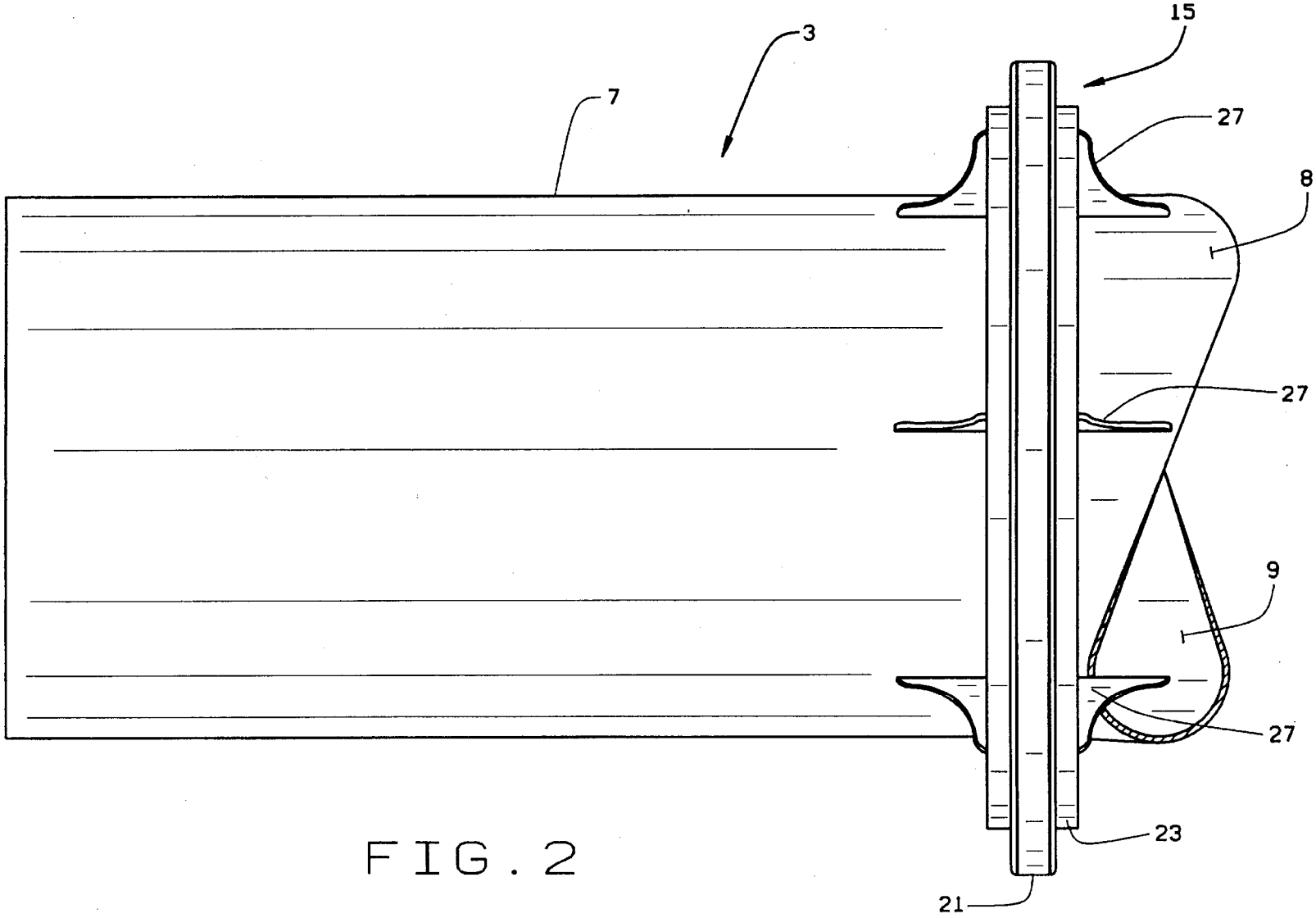
FIG. 2 is an enlarged perspective view of the drum.
Figure 3:
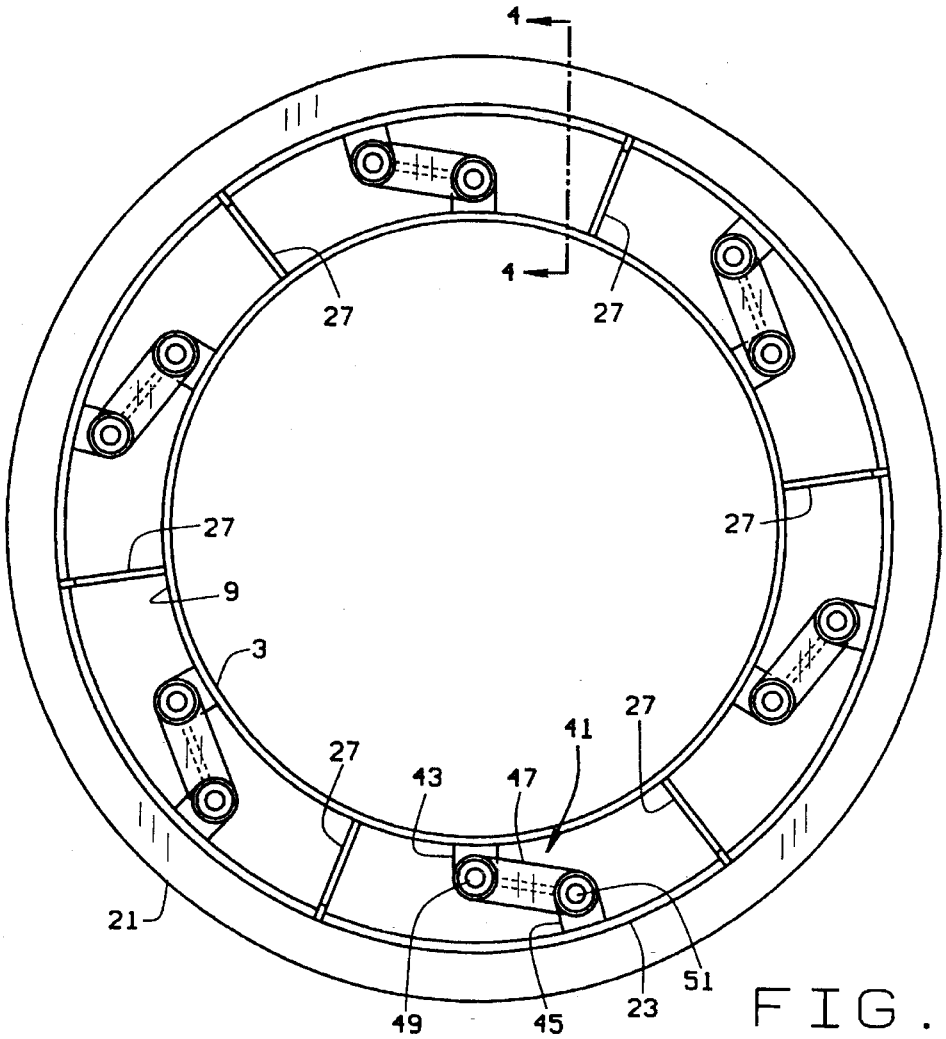
FIG. 3 is a front plan view of the drum.
Figure 4:
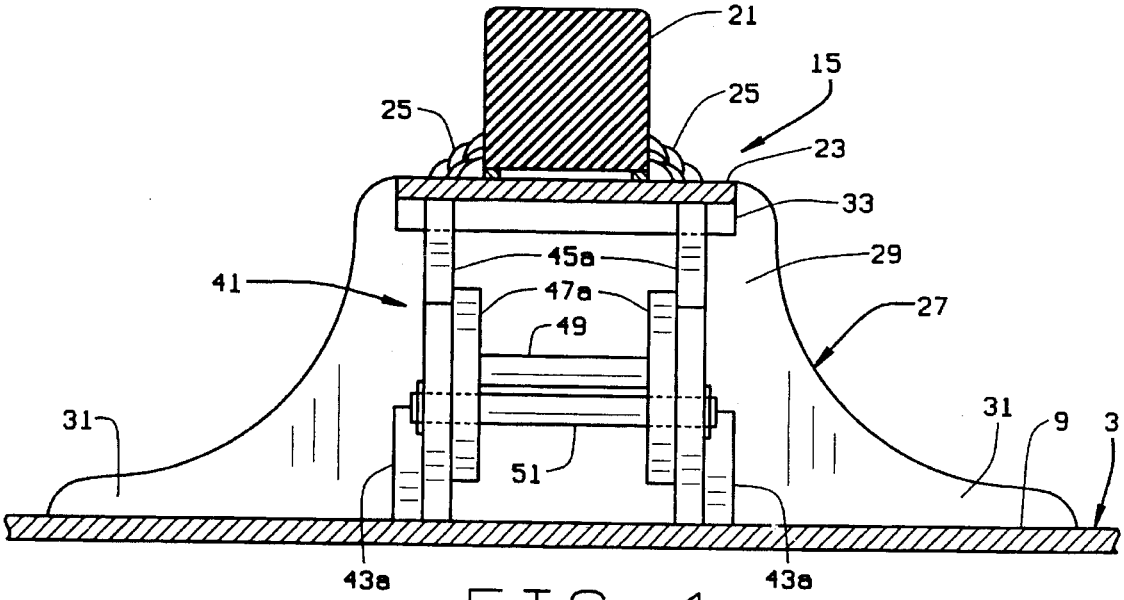
FIG. 4 is a cross-sectional view of the drum taken along line 4—4 of FIG. 3.

The tire assembly 15 is shown in detail in FIGS. 2–4 and includes a tire 21 mounted on a band 23. Shims 25 may be provided to space the tire 21 slightly from the band 23. Fillets 25 are placed a various spots around the band to prevent movement of the tire relative to the band.

The band 23 rides on a plurality of gussets 27 which are evenly spaced around the outer surface 9 of the drum 3 and secured thereto, such as by welding. As seen in FIG. 4, the gussets 27 have a central body section 29 with wings 31 extending from either side of the body at the bottom thereof. The wings 29 extend the width of the gusset 27 to give the gusset a longer surface or interface between the gusset 27 and the drum 3. The wings also increase the surface area of the gusset. A notch 33 is formed in the top of the body section 29, and the band 23 rides in this notch. The notch is sized to be deeper than the depth of the band so that the band can move radially in the notch with respect to the drum.

Link assemblies 41 are positioned and centered between the gussets 27 to physically connect the band 23, and hence the tire 21, to the drum 3. The link assembles each include a drum bracket 43 extending upwardly from the drum, a band bracket 45 depending from a radially inner surface of the band 23, and an arm 47 extending between the two brackets. The brackets 43 and 45 are preferably made of two spaced apart legs 43*a* and 45*a* and the arm 47 preferably is made of two arm pieces 47*a*. The arm 47 is pivotally connected to the brackets 43 and 45 at its respective ends by axles 49 and 51.

The gussets 27, as can be appreciated, space the tire from the drum and the tire 21 is not mounted directly to the drum 3. The gussets 27 tend to operate as fins and radiate the heat transferred to them from the drum 3 to the atmosphere, to decrease the amount of heat that is transferred to the tire. The greater surface area provided by the wings facilitates faster removal of the heat from the drum to further reduce the heat that would otherwise reach the tire.

Further, the linkage operates to allow the drum to expand without placing any forces on the tire 21 or the tire band 23. Thus, the tire 21 and tire band 23 will not be forced to expand as the drum expands. This will reduce the wear on the tire. The linkages also allow the drum to move in a vertical plane (with reference to FIG. 3) relative to the tire. Localized forces caused by the tumbling castings within the drum, which may cause the drum to move relative to the tire will thus not be passed through to the tire. Rather, such forces will absorbed by the linkage.

It can also be appreciated that the use of a rubber tire will make the operation of the drum quieter than would otherwise be possible with a metal tire.

As can be seen, the present invention provides a rotary drum dryer which spaces the tire from the drum to reduce heat which may be passed to the tire from the drum. It further allows the drum to expand without causing the tire to expand. Lastly, it will absorb localized forces caused by the tumbling to prevent such forces from reaching the tire.

As variations within the scope of the appended claims may be apparent to those skilled in the art, the foregoing description is set forth only for illustrative purposes and is not meant to be limiting. For example, although the tire 21 is preferably rubber, it may be made of other items. The size and spacing of the linkage assemblies and the gussets can be changed. The linkage assembly could include brackets which are made of one piece, rather than two pieces: These examples are merely illustrative.

We claim:

1. A rotary drum dryer including an elongate cylindrical drum, a base upon which the drum rotates, a band extending circumferencaily around said drum and being radially spaced from said drum, a circumferential tire mounted on said band, and a plurality of linkage assemblies spaced around said drum, said linkage assemblies connecting said band to said drum such that said drum may move relative to said band, each said linkage assembly including a drum bracket mounted to an outer surface of said drum, a band bracket mounted to an inner surface of said band, and an arm pivotally connected at one end to said drum bracket and pivotally connected at another end to said band bracket.

2. The rotary drum dryer of claim 1 wherein said tire is a rubber tire.

3. The rotary drum dryer of claim 1 including a plurality of gussets mounted to said outer surface of said drum, each said gusset including a gusset body having a top edge and a notch formed in said top edge, said band riding in said notch, said notch having a depth greater than the radial width of said band.

4. The rotary drum dryer of claim 3 wherein said gussets are evenly spaced around said drum.

5. The rotary drum dryer of claim 4 wherein said linkage assemblies are generally centered between adjacent gussets.

6. The rotary drum dryer of claim 3 wherein each said gusset includes wings extending from opposite sides of said gusset body at a bottom of said gusset body, such that said gusset is wider at a bottom thereof than at a top thereof.

7. A rotary drum dryer including a base, an elongate cylindrical drum mounted for rotation on said base, said drum including a drum body, a sprocket which is driven by a drive to rotate said drum, at least one tire assembly circumferencially surrounding said drum, means for dissipating heat from said drum to prevent at least some of said heat from reaching said tire assembly, and means for allowing said drum body to expand without exerting expansion forces upon said tire assembly.

8. The rotary drum dryer of claim 7 wherein said tire assembly is radially spaced form said drum, said expanding means includes a plurality of linkage assemblies, each said linkage assembly including a first bracket mounted to an outer surface of said drum, a second bracket mounted to said tire assembly, and an arm pivotally connected to each of said brackets.

9. The rotary drum dryer of claim 8 wherein said each said bracket includes two spaced apart pieces, and said arm includes two spaced apart pieces, said arm pieces being pivotally connected to said bracket pieces by axles.

10. The rotary drum dryer of claim 7 wherein said heat dissipating means includes a plurality of gussets spaced about a diameter of said drum, each gusset Including a gusset body having a top edge and a notch formed in said top edge, said tire assembly riding in said notch, said gusset mainlining a space between said tire assembly and said drum and operating as a fin to dissipate heat to the atmosphere.

11. The rotary drum dryer of claim 10 wherein said tire assembly includes a band and a tire mounted to said band, said notch having a depth greater than the radial witdth of said band.

12. The rotary drum dryer of claim 10 wherein each said gusset includes wings extending from opposite sides of said gusset body at a bottom of said gusset body, such that said gusset is wider at a bottom thereof than at a top thereof.

* * * * *